US012359561B2

(12) United States Patent
Shanks et al.

(10) Patent No.: US 12,359,561 B2
(45) Date of Patent: Jul. 15, 2025

(54) WELL BORE INSTRUMENT SYSTEM

(71) Applicant: Expro North Sea Limited, Dyce (GB)

(72) Inventors: David Sirda Shanks, Newmachar (GB); John McKay, Stonehaven (GB)

(73) Assignee: EXPRO NORTH SEA LIMITED, Dyce (GB)

( * ) Notice: Subject to any disclaimer, the term of this patent is extended or adjusted under 35 U.S.C. 154(b) by 0 days.

(21) Appl. No.: 17/764,045

(22) PCT Filed: Sep. 4, 2020

(86) PCT No.: PCT/GB2020/052125

§ 371 (c)(1),
(2) Date: Mar. 25, 2022

(87) PCT Pub. No.: WO2021/058937

PCT Pub. Date: Apr. 1, 2021

(65) Prior Publication Data

US 2022/0372867 A1 Nov. 24, 2022

(30) Foreign Application Priority Data

Sep. 26, 2019 (GB) ..... 1913915

(51) Int. Cl.
*E21B 47/12* (2012.01)

(52) U.S. Cl.
CPC ..... *E21B 47/12* (2013.01)

(58) Field of Classification Search
CPC ..... E21B 47/12; E21B 47/125; E21B 47/135; E21B 47/138; E21B 47/14
See application file for complete search history.

(56) References Cited

U.S. PATENT DOCUMENTS

| | | | | |
|---|---|---|---|---|
| 6,608,566 | B1 | 8/2003 | Davis | |
| 6,977,867 | B2 * | 12/2005 | Chamberlain | G01V 1/22 367/76 |
| 7,363,384 | B2 * | 4/2008 | Chatani | H04L 67/59 709/229 |
| 9,447,677 | B2 * | 9/2016 | Fielder | F04B 49/06 |
| 9,736,367 | B1 * | 8/2017 | Alam | H04N 23/698 |
| 10,257,847 | B2 * | 4/2019 | Das | H04W 72/51 |
| 11,082,598 | B2 * | 8/2021 | Sidar | H04N 23/56 |
| 2016/0251956 | A1 | 9/2016 | Parra | |
| 2016/0312554 | A1 | 10/2016 | Gleitman | |
| 2019/0007159 | A1 * | 1/2019 | Dufour | E21B 47/12 |

* cited by examiner

*Primary Examiner* — Franklin D Balseca
(74) *Attorney, Agent, or Firm* — Getz Balich LLC

(57) ABSTRACT

A well bore instrument system is provided. The well bore instrument system includes a cable for conveying control signals and data signals; sensors positioned along the cable; and a controller operable to send control signals to the sensors and receive sensor data signals from the sensors via the cable. The controller is configured to transmit the control signals to the sensors at a control signal bit rate, wherein a sensor of the sensors is configured to receive the control signals and transmit sensor data signals to the controller at a sensor data bit rate, and wherein the sensor data bit rate is greater than the control signal bit rate.

6 Claims, 8 Drawing Sheets

WELL BORE INSTRUMENT SYSTEM

This application claims priority to PCT Patent Appln. No. PCT/GB2020/052125 filed Sep. 4, 2020, which claims priority GB Patent Appln. No. 1913915.3 filed Sep. 26, 2019, which are herein incorporated by reference.

BACKGROUND OF THE INVENTION

1. Technical Field

This disclosure relates to a well bore instrument system and control methods relating thereto. In particular, this disclosure relates to a control unit and sensors of a well bore instrument system configured to communicate with one another at different bit rates.

2. Background Information

In the oil and gas industry, well bore holes are monitored for pressure and temperature, among a number of other characteristics. To obtain permanent monitoring of well bore hole characteristics, existing measurements systems have an electronic sensor module installed on the fluid-producing tubing, and a single conductor tubing encapsulated cable wire is run to surface.

Some measurement systems provide multiple measurement points which use a plurality of either discrete electronic sensor modules on a single cable, or optical fiber-based sensors distributed over an active zone of a well bore, to provide measurements at various locations in the bore hole simultaneously. Multiple sensors provide gradient information and measure the areas in an open hole where fluid is injected or fluid composition changes.

A greater rate of measurements transmitted to surface provides a more detailed picture of the characteristics down hole in the well bore. The more sensors there are installed on the down hole cable the greater the data rate along the cable needs to be to communicate all the data gathered by the sensors in a given time period.

Signals are attenuated as they travel along the cable. The greater the distance along the cable that a signal travels, the more the signal will be attenuated. Further, the higher the frequency of the signal, the more the signal is attenuated over a given distance travelled along the cable.

Further, the maximum bit rate achievable along a cable of a given length is limited by the bandwidth of the cable and the signal-to-noise ratio of the transmission system. Increasing the number of sensors installed on the cable increases the total amount of data being transmitted along the cable, which means the bandwidth of the cable and signal-to-noise ratio increasingly limit the total number of measurements that can be received from the sensors.

One historical drawback of existing systems is, where the system includes a large number of sensors, obtaining a sufficiently high data rate from the sensors to surface to achieve reasonable data update rates is difficult, particularly when the cables of the system extend thousands of meters down a well bore. The bandwidth of the cable is especially impacted in cases where the cable extends such distances Additionally, well bore environments are often harsh, with deeper areas having elevated pressure and temperature compared to areas nearer the surface. Sensors which can operate effectively in down hole environments require electronics which are small enough to be installed on a cable between production tubing and the casing and robust enough to operate at elevated temperatures and pressures. As the complexity of such electronics increases, so does their cost.

SUMMARY OF THE INVENTION

Aspects of the disclosure are set out in the accompanying independent and dependent claims. Combinations of features from the dependent claims may be combined with features of the independent claims as appropriate and not merely as explicitly set out in the claims.

According to an aspect of the present disclosure, there is provided a well bore instrument system, comprising: a cable for conveying control signals and data signals; a plurality of sensors positioned along the cable; and a controller operable to send control signals to the sensors and receive sensor data signals from the sensors via the cable; wherein the controller is configured to transmit the control signals to the sensors at a control signal bit rate, wherein a first sensor of the plurality of sensors is configured to receive the control signals and transmit sensor data signals to the controller at a first sensor data bit rate, and wherein the first sensor data bit rate is greater than the control signal bit rate.

By providing control signals at a lower bit rate than sensor data signals, sensors can be manufactured to be simpler and more robust and therefore more likely to survive and function correctly in down hole environments. Further, by providing sensor data signals at a higher bit rate than that of the control signals, the sensors can provide a greater amount of measurement data over a given time period, thereby reducing the amount of time taken to gather a required amount of measurement data.

A second sensor may be configured to transmit second sensor data signals to the controller at a second sensor data bit rate. The second sensor data bit rate may be greater than the first sensor data bit rate.

This can allow the sensors to maximize the amount of measurement data they can provide given restrictions such as electrical noise. Additionally, this enables the controller to more easily identify the source of each data packet it receives.

The first sensor may be connected to the cable a first distance along the cable from the controller. The second sensor may be connected to the cable a second distance along the cable from the controller. The first distance may be greater than the second distance. The difference between the first distance and second distance may be proportional to the difference between the first bit rate and second bit rate.

By so arranging the first second and second sensor, the amount of measurement data retrievable from each sensor can be maximized as the amount of attenuation due to the distance travelled by the sensor data signals along the cable is taken into account for determining the first and second data signal bit rates.

The controller may be configured to query the plurality of sensors to determine a plurality of respective sensor data bit rate maxima.

This can increase the versatility of the well bore instrument system by enabling the sensor data bit rates to be chosen in accordance with a given environment.

At least one of the plurality of sensors may be configured to transmit a sensor data signal comprising an indication of sensor data bit rate.

This can enable the controller to more easily determine an appropriate sensor data bit rate for communicating with the at least one sensor.

The controller and at least one sensor may be configured to store the indicated sensor data bit rate.

This can reduce the likelihood that further determinations of sensor data bit rate must be made, thereby reducing set up time.

At least one sensor may be configured to transmit data signals at a continuously variable sensor data bit rate. The continuously variable sensor data bit rate may be continuously variable between 20 kHz and 1 MHz.

This can provide a broad range of possible operating frequencies so that the well bore instrument system is able to gather measurement data in a wide variety of environments.

The controller may be configured to filter electrical noise from the sensor data signals.

This can simplify the construction of the sensors, as the filtering may instead be performed at the surface.

At least one sensor may be configured to transmit sensor data signals at a sensor data frequency which is different to a frequency of electrical noise introduced to the system by the at least one sensor.

This can decrease the signal-to-noise ratio of sensor data signals received by the controller, thereby reducing the amount of power required to propagate the data signals at a resolvable intensity.

The controller may be configured to identify at least one frequency of electrical noise introduced to the system by at least one sensor or the controller and configure the at least one sensor to transmit sensor data signals at a sensor data frequency which is different to the at least one identified frequency of noise.

This can enable the controller to identify at least one frequency at which a sensor should operate to reduce the signal-to-noise ratio, which in turn can enable the well bore instrument system to perform the identification at will, such as when the down hole environment changes, thereby increasing the versatility of the system.

The controller may be configured to configure the at least one sensor to transmit sensor data signals at a sensor data frequency corresponding to a frequency of noise at which the intensity of the noise is at a minimum.

This can minimize the signal-to-noise ratio of the at least one sensor for a given environment.

At least one sensor may be configured to filter electrical noise from the control signals.

This can enable the sensor to be more likely to correctly interpret and execute commands sent by the controller.

According to another aspect of the present disclosure, there is provided a well bore sensor for a well bore instrument system, the well bore instrument system comprising: a cable for conveying control signals and data signals; and a controller operable to send control signals to the sensors and receive sensor data signals from the sensors; wherein the sensor is installable on the cable and is configured to: receive and process control signals from the controller at a control signal bit rate; and transmit sensor data signals from the sensor at a sensor data bit rate, wherein the sensor data bit rate is greater than the control signal bit rate.

The well bore sensor may be further configured to transmit a sensor data signal comprising an indication of sensor data bit rate.

According to another aspect of the present disclosure, there is provided a controller for a well bore instrument system, the well bore instrument system comprising: a cable for conveying control signals and data signals; and a plurality of sensors positioned along the cable; wherein the controller is configured to: transmit control signals to the sensors at a control signal bit rate; and receive, from at least one sensor of the plurality of sensors, sensor data signals at a sensor data bit rate, wherein the sensor data bit rate is greater than the control signal bit rate.

The controller may be further configured to query the plurality of sensors to determine a plurality of respective sensor data bit rate maxima.

According to another aspect of the present disclosure, there is provided a method for measuring a well bore environment using a wellbore instrument system, the well bore instrument system comprising: a cable for conveying control signals and data signals; a plurality of sensors positioned along the cable; and a controller operable to send control signals to the sensors and receive sensor data signals from the sensors via the cable; the method comprising:

(iii) transmitting control signals from the controller at a control signal data bit rate to a plurality of sensors via the cable; and (iv) transmitting sensor data signals from a first sensor of the plurality of sensors to the controller via the cable at a first sensor data bit rate, wherein the first sensor data bit rate is greater than the control signal bit rate.

The method may further comprise the step of transmitting sensor data signals from a second sensor of the plurality of sensors to the controller at a second sensor data bit rate. The second sensor data bit rate may be greater than the first sensor data bit rate.

The method may further comprise the step of connecting the first sensor to the cable a first distance along the cable from the controller and connecting the second sensor to the cable a second distance along the cable from the controller. The first distance may be greater than the second distance.

According to another aspect of the present disclosure, there is provided a method for communicating measurements of a well bore environment using a wellbore instrument system, the well bore instrument system comprising: a cable for conveying control signals and data signals; a plurality of sensors positioned along the cable; and a controller operable to send control signals to the sensors and receive sensor data signals from the sensors; the method comprising:

(iii) receiving, at a plurality of sensors, control signals from the controller at a control signal data bit rate via the cable; and (iv) transmitting sensor data signals from a first sensor of the plurality of sensors to the controller via the cable at a first sensor data bit rate, wherein the first sensor data bit rate is greater than the control signal bit rate.

The method may further comprise the step of transmitting sensor data signals from a second sensor of the plurality of sensors to the controller at a second sensor data bit rate. The second sensor data bit rate may be greater than the first sensor data bit rate.

The method may further comprise the step of connecting the first sensor to the cable a first distance along the cable from the controller and connecting the second sensor to the cable a second distance along the cable from the controller. The first distance may be greater than the second distance.

According to another aspect of the present disclosure, there is provided a method for gathering measurements of a well bore environment using a wellbore instrument system, the well bore instrument system comprising: a cable for conveying control signals and data signals; a plurality of sensors positioned along the cable; and a controller operable to send control signals to the sensors and receive sensor data signals from the sensors; the method:

(iii) sending control signals from the controller at a control signal data bit rate to a plurality of sensors via the cable; and (iv) the controller receiving, from at least one of the plurality of sensors, sensor data signals at a sensor data bit rate via the cable, wherein the sensor data bit rate is greater than the control signal bit rate.

The method may further comprise the step of querying the plurality of sensors to determine a plurality of respective sensor data bit rate maxima.

BRIEF DESCRIPTION OF THE DRAWINGS

Embodiments of the present disclosure will be described hereinafter, by way of example only, with reference to the accompanying drawings in which like reference signs relate to like elements and in which.

DETAILED DESCRIPTION OF THE INVENTION

Embodiments of the present disclosure are described in the following with reference to the accompanying drawings.

Figure 1:
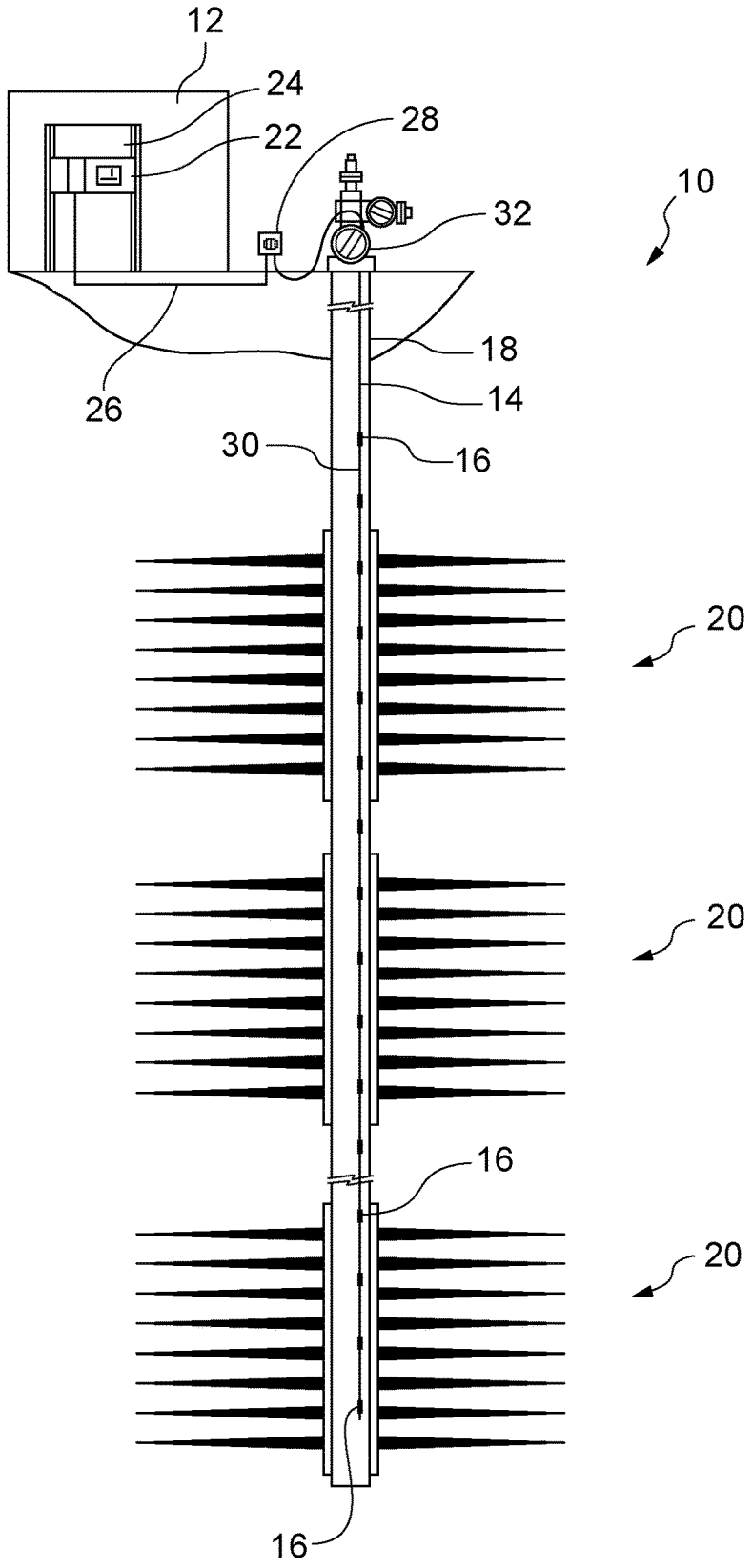
FIG. 1 shows a well bore instrument system in accordance with an embodiment of the disclosure.

Referring to FIG. 1, a well bore instrument system 10 is shown comprising a controller in the form of a surface unit 12, a cable 14, and a plurality of sensors in the form of sensor modules 16 mounted on the cable 14 and in communication with the surface unit 12 via the cable 14.

The cable 14 and sensor modules 16 are shown in a deployed configuration in a bore hole 18. The borehole 18 shown comprises three zones 20 of interest.

The surface unit 12 includes a power supply unit 22 for supplying power to the sensor modules 16 via the cable 14 and a data controller 24 for sending instructions to the sensor modules 16 and receiving and processing data from the sensor modules 16 via the cable 14.

The surface unit 12 is connected to and is in communication with the sensor modules 16 via the cable 14, which itself comprises a surface cable section 26, a surface connection point 28, and a downhole cable section 30. The surface connection point 28 connects the surface cable section 26 to the downhole cable section 30. In an embodiment, the downhole cable section 30 is a wireline cable.

The downhole cable section 30, which comprises the sensor modules 16, is secured to the wellhead 32.

Figure 2:
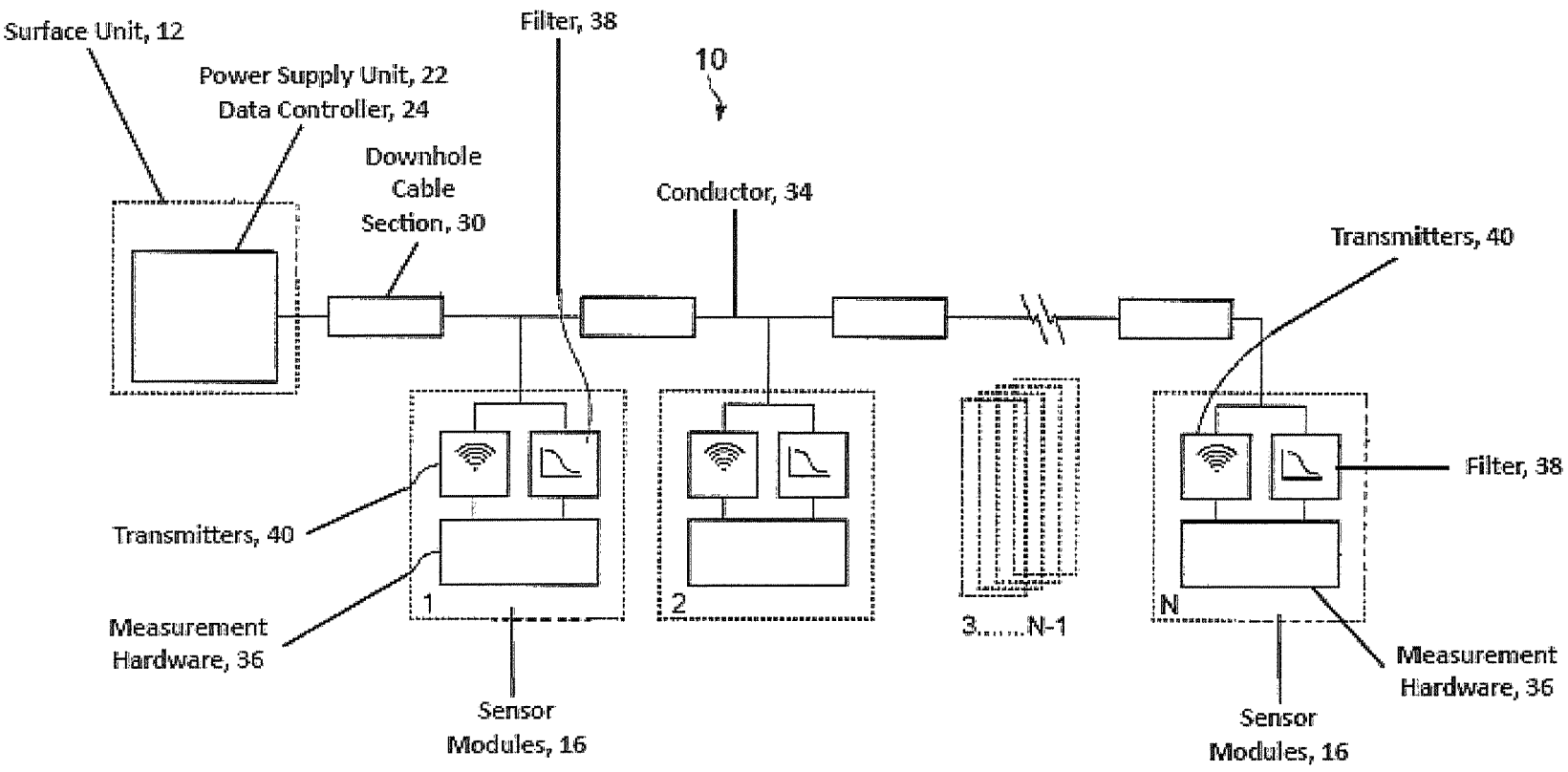
FIG. 2 shows a schematic diagram of a well bore instrument system in accordance with an embodiment of the disclosure.

Referring to FIG. 2, the well bore instrument system 10 is shown in a schematic format. The downhole cable section 30 may comprise a single central conductor 34 encapsulated in an outer sheath (not shown) to provide protection from down hole environments, where fluid pressure and temperature are substantially greater than experienced at surface. The outer sheath may comprise a robust material such as steel. The downhole cable section may be clamped to well production tubing (not shown).

A plurality N of sensor modules 16 are shown, each comprising measurement hardware 36 for measuring quantities such as fluid pressure, temperature, and vibration. It is to be understood that other measurements may also be performed without requiring substantial alteration to the well bore instrument system 10. The measurement hardware 36 includes electronics for converting the measurements into signal data suitable for transmission to the surface unit 12 via the cable 14.

The sensor modules 16, in this embodiment, are also shown each comprising a filter 38, which may be an analogue filter, for allowing delivery of direct current from the cable 14 to the sensor module 16 while providing a high impedance block to any noise generated by the electronics of the sensor module 16.

The sensor modules 16, in this embodiment, are further shown each comprising a transmitter 40 for transmitting measurement data gathered by the sensor module 16 to the surface unit 12 via the cable 14. In one embodiment, the transmitters 40 of the sensor modules 16 may be configured to operate at a different frequency to that of clocks or busses present in the sensor module 16.

Figure 3:
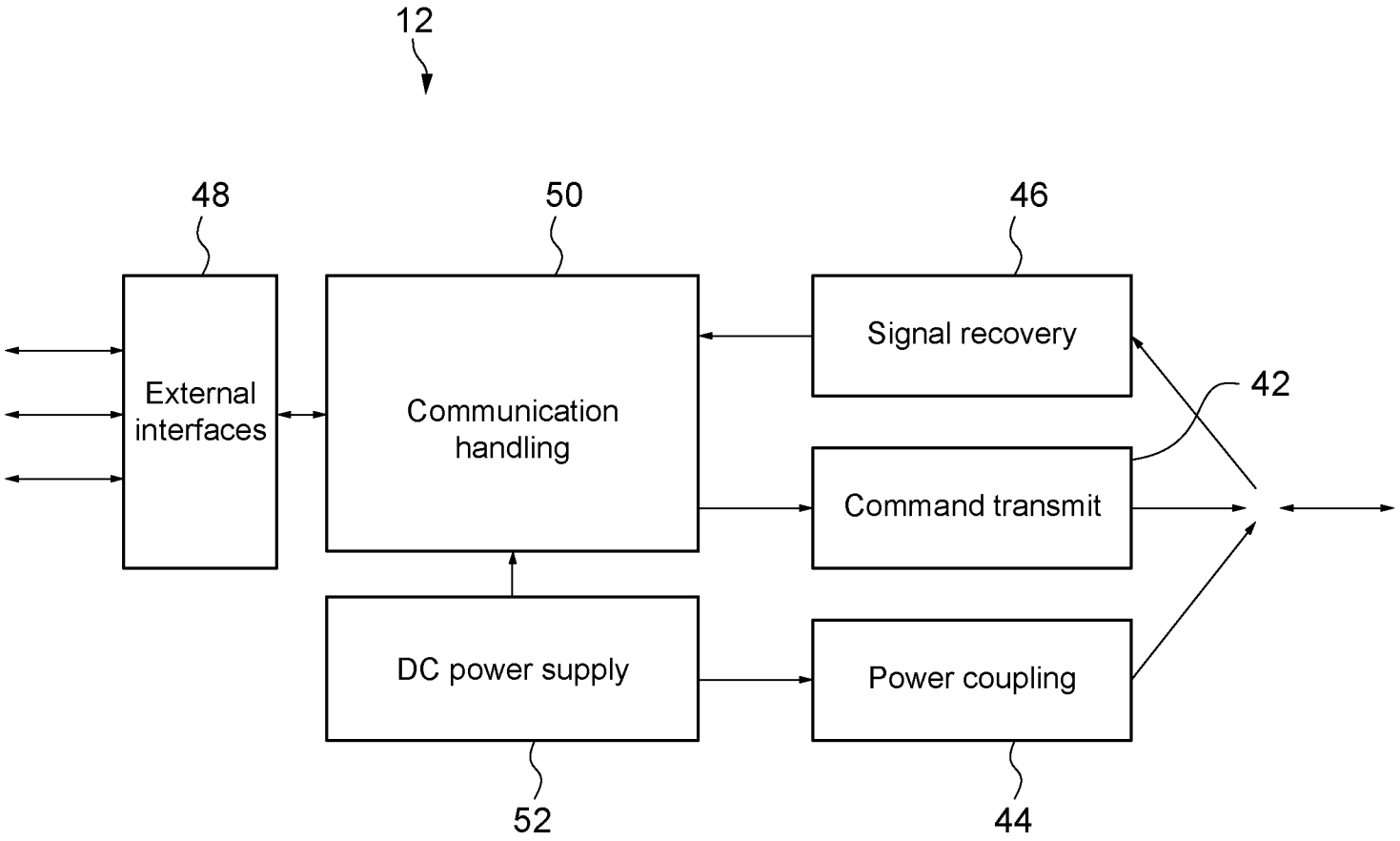
FIG. 3 shows a block diagram of a controller in accordance with an embodiment of the disclosure.

Referring to FIG. 3, the surface unit 12, in this embodiment, comprises a command transmit module 42 for delivering command signals to the sensor modules 16 via the cable 14, a power coupling module 44 for delivering electrical power to the sensor modules 16 via the cable 14, and a signal recovery module 46 for receiving sensor data signals from the sensor modules 16 corresponding to measurement data.

The surface unit 12 may further comprise external interfaces 48, a communication handling module 50 in communication with the external interfaces 48, and a direct current power supply 52 for supplying electrical power to the power coupling module 44 and the communication handling module 50.

The communication handling module 50 may be configured to convey instructions received from a user via the external interfaces 48 to the command transmit module 42. The command transmit module translates the instructions into commands for controlling the sensor modules 16.

The communication handling module 50 may also be configured to receive and process sensor data signals passed to it by the signal recovery module 46, and to convey the sensor data signals to the external interfaces 48. In an embodiment, the external interfaces 48 include a mouse, keyboard, and monitor.

Figure 4:
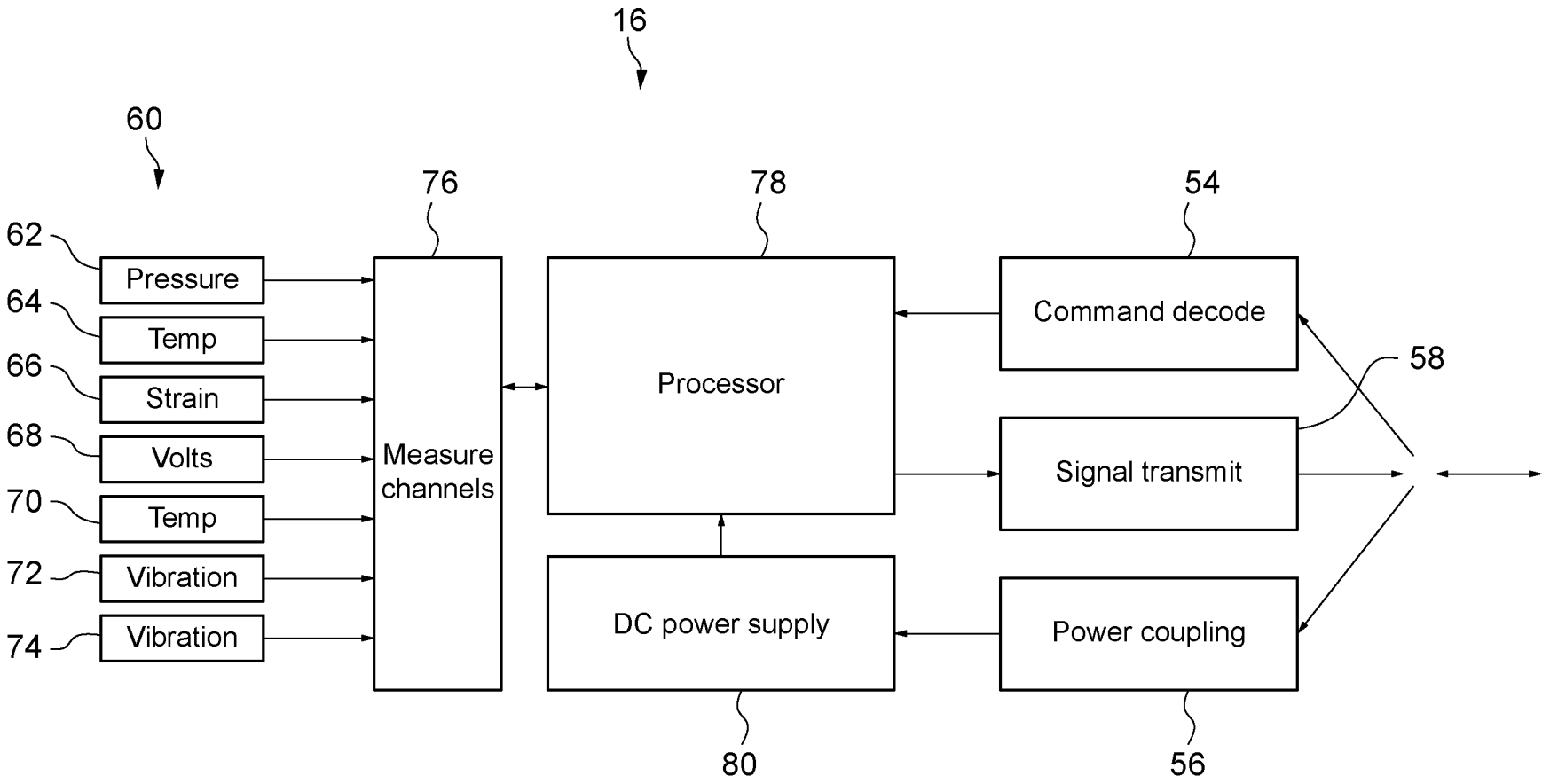
FIG. 4 shows a block diagram of a sensor in accordance with an embodiment of the disclosure.

Referring to FIG. 4, each sensor module 16 in this embodiment comprises a command decoding module 54 for decoding command signals sent by the surface unit 12, a power coupling module 56 for receiving and conveying electrical power to the sensor module 16 from the power supply 52 of the surface unit 12, and a signal transmit module 58 for sending sensor data signals from the sensor module 16 to the surface unit 12.

Each sensor module 16 in this embodiment also comprises a plurality of measurement modules 60. The plurality of measurement modules shown in FIG. 4 includes a pressure module 62, a temperature module 64, a strain module 66, a voltage module 68, a temperature module 70, a first-axis vibration module 72, and a second-axis vibration module 74, though it is to be understood that other combinations are possible.

In one embodiment, the first-axis vibration module 72 measures acoustic vibrations parallel to a first axis and the second-axis vibration module 74 measures components of acoustic vibrations parallel to a second axis. In one embodiment, the first axis and second axis are transverse to one another.

Each sensor module 16 in this embodiment further comprises a measurement channel module 76 for collating measurement data gathered by the plurality of measurement modules 60. Each sensor module 16 can also comprise a processor module 78, and can also comprise a direct current power supply 80 for handling and distributing electrical power to the processor module 78 from the power coupling module 56. The processor module 78 can be configured to receive and execute command signals from the surface unit 12 via the command decoding module 54. The processor module 78 may also receive and process measurement data from the measurement channel module 76, and may also pass measurement data to the signal transmit module 58 for transmission to the surface unit 12 via the cable 14.

Figure 5:
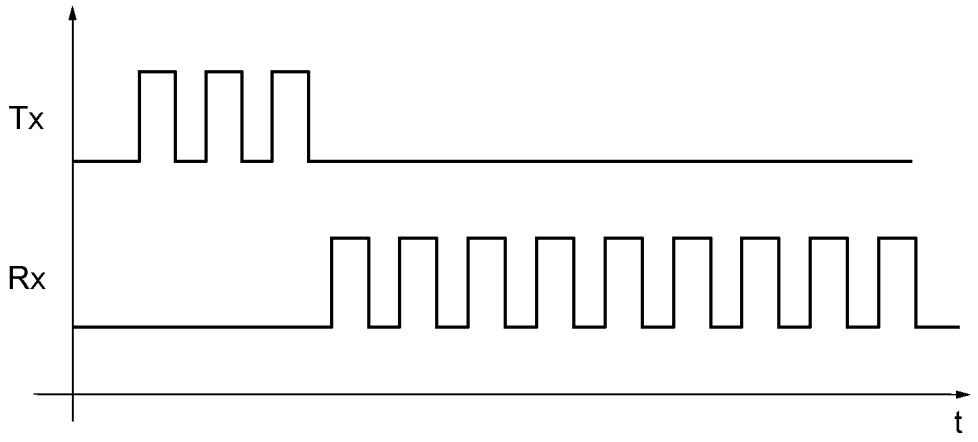
FIG. 5 shows signals from a transmitter and signals from a receiver.

Referring to FIG. 5, a transmitter Tx (such as a surface unit 12) is shown transmitting a command signal and a receiver Rx (such as a sensor module 16) is shown responding with a sensor data signal. The command signal and data sensor signal in this case are sent at identical bit rates.

Figure 6:
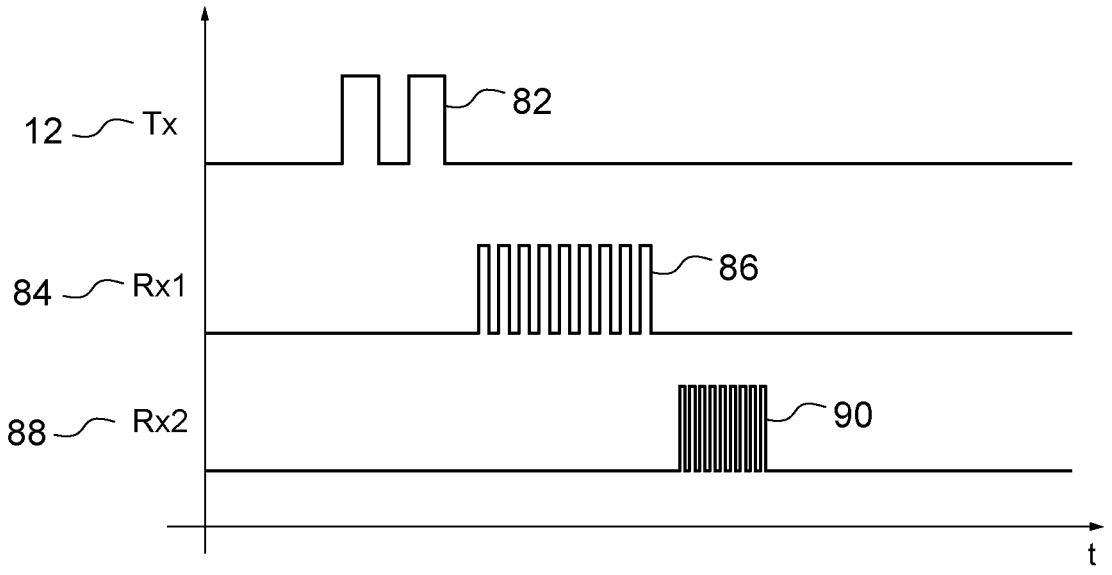
FIG. 6 shows a signal from a controller and signals from two sensors in accordance with an embodiment of the disclosure.

Referring to FIG. 6, the surface unit 12 in this embodiment is shown transmitting a control signal 82 at a control signal bit rate, a first sensor module 84 is shown responding with first sensor data signals 86 at a first data sensor bit rate, and a second sensor module 88 is shown responding with second sensor data signals 90 at a second data sensor bit rate. The first sensor data bit rate is greater than the control signal bit rate, and the second sensor data bit rate is greater than the first data sensor bit rate.

It can be seen from FIG. 6 that the first sensor data signals 86 and second sensor data signals 90 comprise the same number of cycles, and therefore the same total quantity of data, but the second sensor data signals 90 require less time to be received from the beginning of the second sensor data signals 90 to the end than the first sensor data signals 86 do due to the difference in bit rate between the two.

Figure 7:
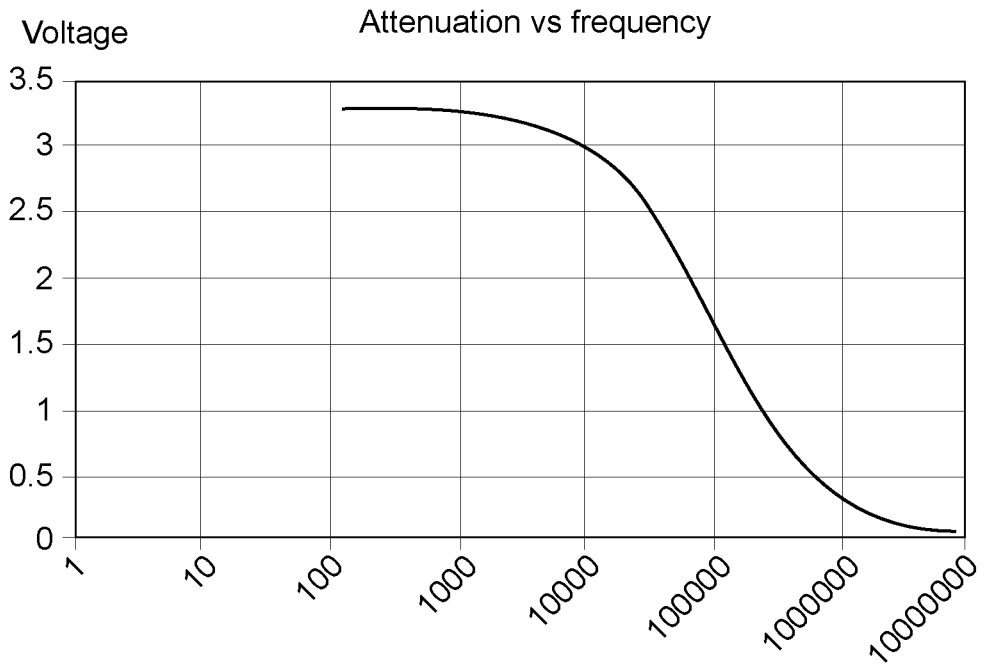
FIG. 7 shows a graph demonstrating the relationship between voltage of a signal and the signal frequency.

As understood by the skilled person and illustrated in FIG. 7, the second sensor data signals 90 are more attenuated as they travel down the cable 14 than the first sensor data signals 86 by virtue of their relatively higher bit rate (and therefore frequency). Therefore, for a given capability of the surface unit 12 in detecting and accurately resolving attenuated sensor data signals, a sensor module 16 transmitting sensor data signals at a given bit rate has a corresponding maximum distance along the cable it can be from the surface unit 12 before the surface unit 12 is no longer able to detect and resolve the sensor data signals the sensor module transmits.

Figure 8:
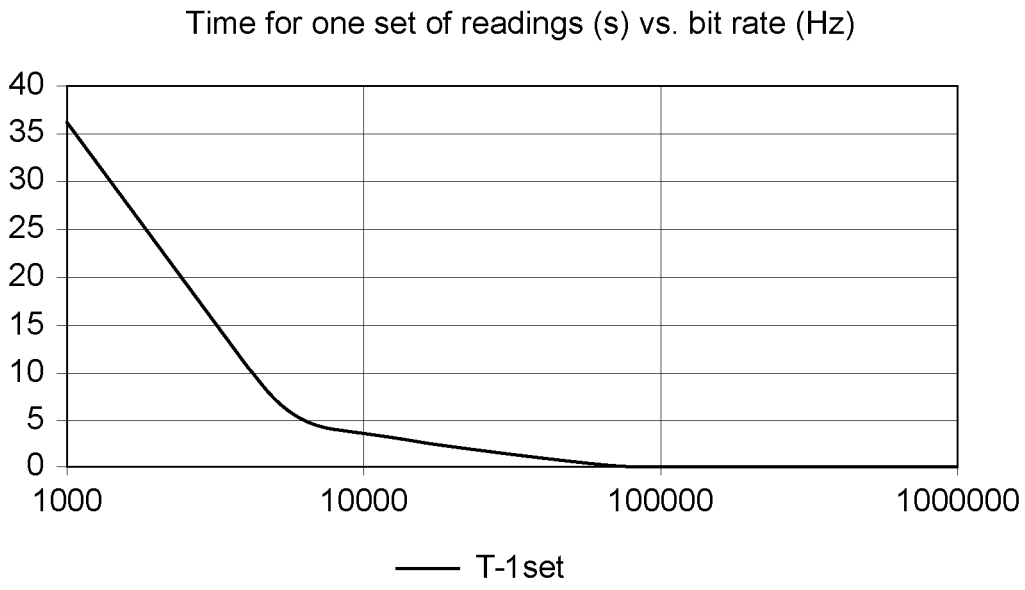
FIG. 8 shows a graph demonstrating the relationship between the amount of time required for receiving a set of readings and the bit rate of the signal containing the readings.

The relationship between the time required for the surface unit 12 to gather a set of sensor data signals from the plurality of sensor modules 16 and the bit rate at which the sensor data signals are sent to the surface unit 12 is shown in FIG. 8. It can be seen from FIG. 8 that a higher bit rate is preferred as it allows more measurement data from the sensor data signals to be gathered in a given time.

However, the more attenuation due to higher bit rates there is, the more difficult it is to receive and resolve the sensor data signals, and the more complex and expensive the electronics in both the surface unit 12 and sensor modules 16 needs to be to successfully gather measurements.

The following table illustrates what data is being transmitted along the cable 14 by one sensor module 16 in accordance with an embodiment of the disclosure:

TABLE 1

| | Bits | Range | resolution | Number of readings |
|---|---|---|---|---|
| Overhead in transmissions | | | 20% | |
| Temp reading | 16 | 200 | 0.00305 | 3 |
| Pressure reading | 24 | 10000 | 0.0006 | 1 |
| Vibration | 12 | 50 | 0.01221 | 2 |
| Strain | 12 | 100 | 0.02441 | 1 |
| status information | 16 | 1 | 1 | 1 |
| Volts | 8 | 50 | 0.19531 | 1 |
| total data packet no oh | 132 | | | 9 |
| total packet | 159 | | | |
| Transmit message | 12 | bits | | |
| delay Tx/Rx | 80 | bits | | |
| 1 Data cycle | 331 | bits | | |

There are three temperature measurements: one external, one internal, and one for sensor compensation. There is one pressure measurement. There are two vibration measurements: one for each of the first axis and second axis as described above. The vibrations are mostly from vibration of fluid flow. There is one stress measurement for monitoring health of seals of the sensor module 16. There is one indication of status. There is one indication of voltage across the cable 14.

In the case of the above table, the total number of bits in one transmission from one sensor module 16 is one hundred and fifty-nine, which includes a twenty percent overhead for CRC headers, addresses, and the like. The delay, in bit time, between transmission of the control signal and reception of the data signals is eight bits. The total data cycle is three hundred and thirty-one bits long.

Therefore, in an embodiment where there are one hundred sensor modules 16 installed on the cable 14, 33100 bits of data must be recovered in order to get one set of measurement data from the sensor modules 16. If the bit rate is 50 kHz, approximately three readings are achieved every two seconds, while if the bit rate is 100 Hz, it takes approximately five and a half minutes to get one reading.

In an embodiment of the disclosure, described in detail below, the sensor data signal bit rate of each sensor module 16 is chosen based on a distance from the surface unit 12 along the cable 14 to that sensor module 16, thereby maximizing the amount of sensor data signals that can be received and resolved by the surface unit 12 in a given time.

Where there are two sensor modules 84, 88 mounted on the cable, and where the first sensor module 84 is located a first distance along the cable from the surface unit 12 and the second sensor module 88 is located a second distance along the cable from the surface unit 12, the second distance being less than the first distance, the first data sensor bit rate at which the first sensor module 84 transmits first sensor data signals 86 to the surface unit 12 via the cable 14 is less than the second sensor data bit rate at which the second sensor module 88 transmits second sensor data signals 90 to the surface unit 12 via the cable.

The difference between the first sensor data bit rate and the second sensor data bit rate is chosen based on the difference between the first distance and the second distance. In an embodiment, the difference between the first sensor data bit rate and the second sensor data bit rate is chosen to be proportional to the difference between the first distance and the second distance.

In an embodiment, where there are N>2 sensor modules 16 installed on the cable 14, the data sensor bit rates at which each sensor module 16 is configured to transmit are chosen based on the distance along the cable between the surface unit 12 and the corresponding sensor module 16. In this way, each sensor module 16 located successively further from the surface unit 12 can be configured to transmit at a lower bit rate than the preceding, closer sensor module 16. This configuration can maximize the total amount of data that the surface unit 12 receives from the plurality of sensor modules 16 in a given time period for a given capability of the well bore instrument system 10 to resolve attenuated sensor data signals.

Figure 10:
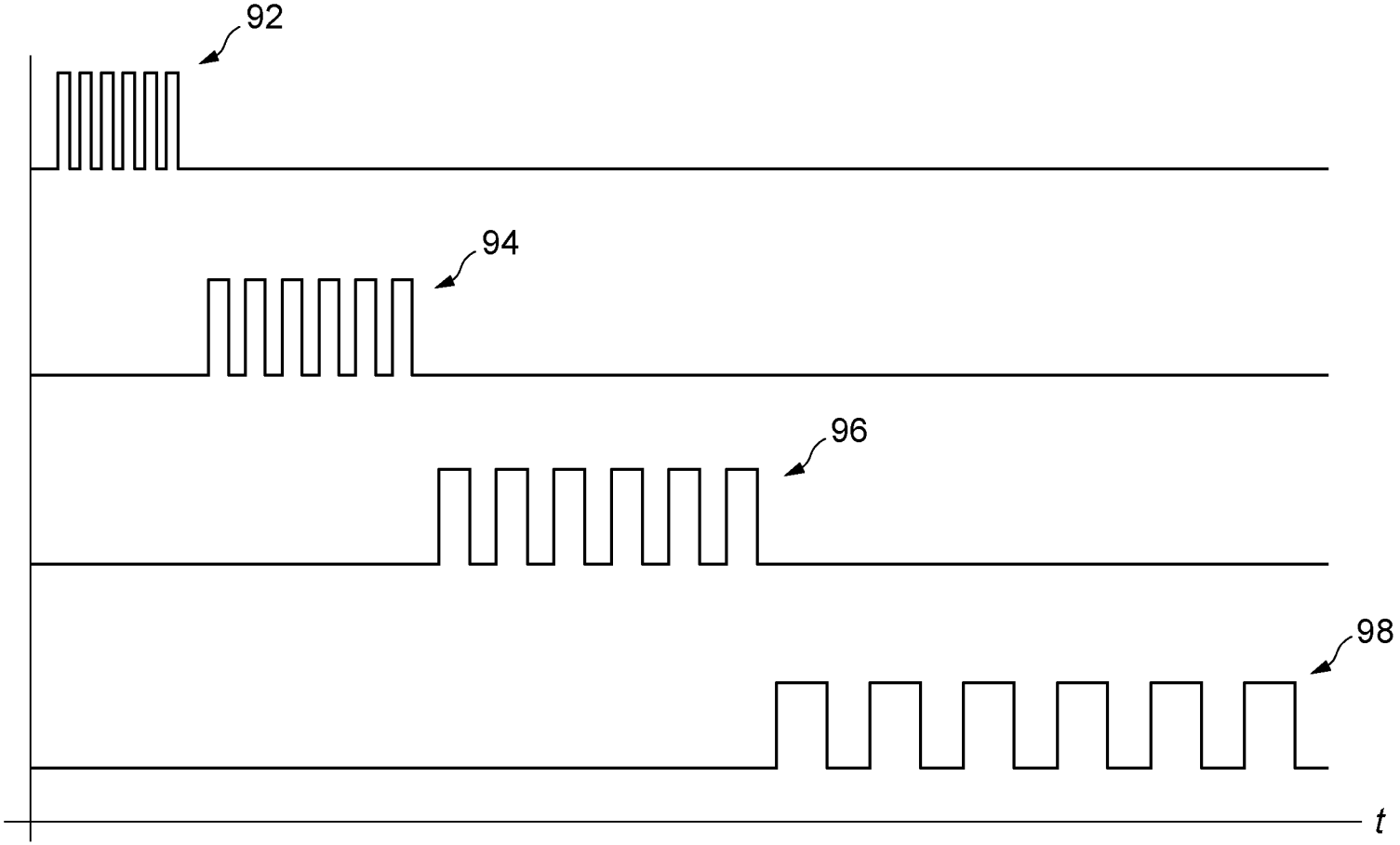
FIG. 10 shows signals from a plurality of sensors in accordance with an embodiment of the disclosure.

Relative sensor data bit rates of an embodiment where N=4 are illustrated in FIG. 10, which shows an example of sensor data signals 92, 94, 96, 98 received by the surface unit 12 over time.

In an embodiment, the instrument system is configured to determine what sensor data signal bit rates the well bore instrument system 10 can resolve by following the steps of FIG. 9, described below.

First (S1), the surface unit 12 instructs a sensor module 16 to transmit sensor data signals at a variety of bit rates.

After the sensor module 16 acknowledges (S2) the instruction, the sensor module 16 sends (S3), in one embodiment, ten data packets at increasing bit rates.

The surface unit 12 examines the data packets it receives from the sensor module 16 and determines (S4), based on the amount of attenuation and noise present, a maximum bit rate that the well bore instrument system 10 can support that sensor module 16 transmitting. In an embodiment, the surface unit 12 stores this information for further uses, such as analysis and troubleshooting.

The surface unit 12 then communicates (S5) to the sensor module 16 the maximum bit rate. The sensor module 16 stores the maximum bit rate. In this way the surface unit 12 configures the sensor module 16 to subsequently transmit at that maximum bit rate.

The surface unit 12 repeats this process for any unconfigured sensor modules 16 until all sensor modules 16 have been configured with respective maximum bit rates. In an embodiment, the maximum bit rates vary between 10 kHz and 1 MHz.

Figure 9:
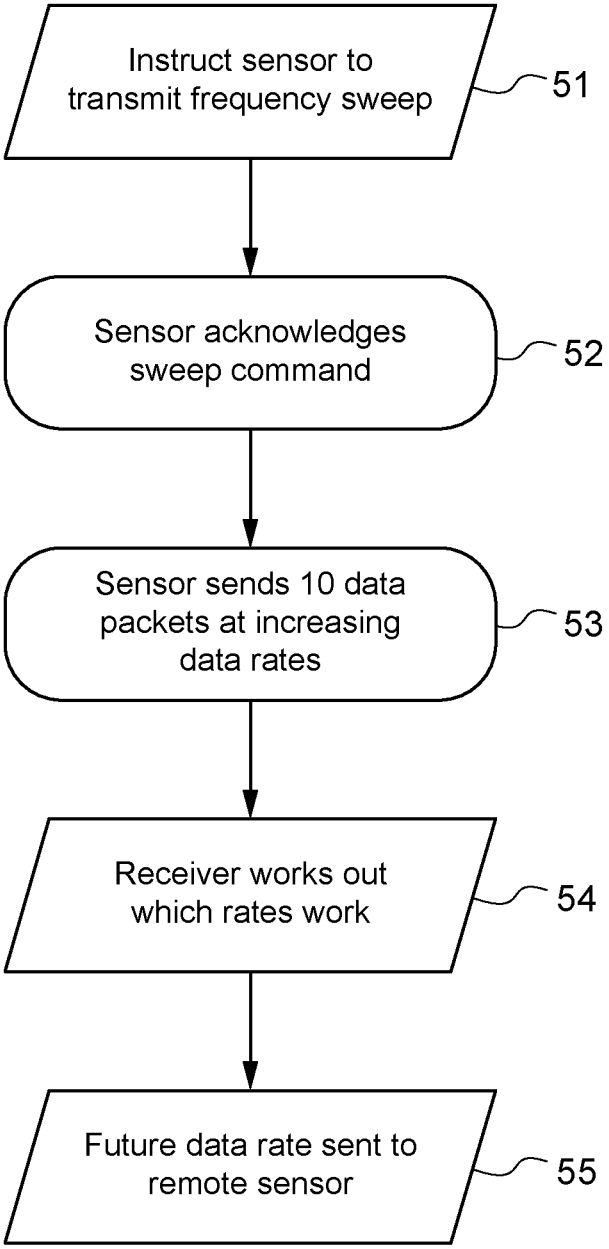
FIG. 9 shows a flow chart illustrating the steps in a data rate test in accordance with an embodiment of the disclosure.

In an embodiment, in addition to being configured to carry out the steps of FIG. 9, the surface unit 12 is configured to determine voltage and current present on the cable 14 in the absence of data transmission, perform a frequency analysis of any noise present, thereby identifying frequencies at which the sensor modules 16 or surface unit 12 are introducing noise, and configure at least one of the surface unit 12 and sensor modules 16 to avoid communicating with the other at the identified noise frequencies.

In an embodiment, the surface unit 12 is configured to transmit control signals in a first control scheme. In another embodiment, the surface unit 12 is configured to transmit control signals according to a second, simplified, control scheme. In a further embodiment, the surface unit 12 is configured to transmit control signals according to a third, severely simplified, control scheme.

Table 2 illustrates the first control scheme, Table 3 illustrates the simplified control scheme, and Table 4 illustrates the severely simplified control scheme:

TABLE 2

| Name | length (bits) | Function |
|---|---|---|
| Start | | Starts with colon: (ASCII hex value is 3A) |
| Address | 16 | Station address |
| Function | 16 | Indicates the function codes like read coils/inputs |
| Data | n × 32 | Data + length will be filled depending on the message type |
| LRC | 16 | Checksum (Longitudinal redundancy check) |
| End | 16 | Carriage return - line feed (CR/LF) pair (ASCII values of 0D, 0A) |
| total | 136 | assume n = 2 |

TABLE 3

| ame | length (bits) | Function |
|---|---|---|
| Start | 4 | Starts with custom non-ascii pattern |
| Address | 4 | Station address |
| Function | 4 | Indicates the function codes like read coils/inputs |
| Data | 0 | work with only functions with no clarifying data |
| LRC | 0 | by simplifying commands the need for a checksum is reduced |
| End | 4 | use a custom non-ascii end character |
| total | 16 | |
| result | 12% | of initial command size |

TABLE 4

| Name | length (bits) | Function |
|---|---|---|
| Start | 3 | Starts with custom non-ascii pattern |
| Address | | Station address |
| Function | 3 | Indicates the function codes like read coils/inputs |
| Data | 0 | work with only functions with no clarifying data |
| LRC | 0 | by simplifying commands the need for a checksum is reduced |
| End | 0 | use a custom non-ascii end character |
| total | 10 | |
| result | 7% | of initial command size |

When operating under the simplified control scheme, the surface unit 12 can send control signals having a size of twelve percent of control signals according to the first control scheme. While operating under the severely simplified control scheme, the surface unit 12 can send control signals having a size of seven percent of control signals according to the first control scheme. The simplified control schemes allow for simpler, cheaper, and more robust electronics to be installed in the sensor modules 16 and decreases the amount of time it takes for a sensor module 16 to receive and interpret control signals.

Accordingly, there has been described a well bore instrument system. The well bore instrument systems includes a cable for conveying control signals and data signals; sensors positioned along the cable; and a controller operable to send control signals to the sensors and receive sensor data signals from the sensors via the cable. The controller is configured to transmit the control signals to the sensors at a control signal bit rate, wherein a sensor of the sensors is configured to receive the control signals and transmit sensor data signals to the controller at a sensor data bit rate, and wherein the sensor data bit rate is greater than the control signal bit rate.

Although particular embodiments of the disclosure have been described, it will be appreciated that many modifications/additions and/or substitutions may be made within the scope of the claimed disclosure.

The invention claimed is:

1. A well bore instrument system for use in a well having a bore hole that extends down hole from a wellhead, comprising:

a surface unit that includes a controller;

a cable configured to convey signals, the cable including a downhole cable section configured for deployment within the bore hole, the downhole cable section configured to extend lengthwise between the wellhead and a terminal end, and wherein the cable also extends from the wellhead to the controller; and a plurality of sensors, each said sensor in communication with the downhole cable section, the sensors including:

a first sensor disposed at a first lengthwise distance along the cable from the controller, wherein the first sensor is configured to transmit first sensor data signals at a first sensor data bit rate that is based on a first amount of signal attenuation associated with the first lengthwise distance;

a second sensor disposed at a second lengthwise distance along the cable from the controller, wherein the second sensor is configured to transmit second sensor data signals at a second sensor data bit rate that is based on a second amount of signal attenuation associated with the second lengthwise distance;

wherein the first lengthwise distance is greater than the second lengthwise distance, and the first amount of signal attenuation associated with the first lengthwise distance is greater than the second amount of signal attenuation associated with the second lengthwise distance, and the first sensor data bit rate is less than the second sensor data bit rate; and wherein the controller is configured to send first control signals to the first sensor at a control signal bit rate and to receive said first sensor data signals from the first sensor via the cable, and configured to send second control signals to the second sensor at the control signal bit rate and to receive said second sensor data signals from the second sensor via the cable; and wherein the first sensor data bit rate and the second sensor data bit rate are each greater than the control signal bit rate; and wherein the controller is configured to query the first sensor to determine a first sensor data bit rate maxima based on the first amount of signal attenuation associated with the first lengthwise distance and to query the second sensor to determine a second sensor data bit rate maxima based on the second amount of signal attenuation associated with the second lengthwise distance.

2. The well bore instrument system of claim 1, wherein the first sensor data signals comprise a first indication of sensor data bit rate, and/or the second sensor data signals comprise a second indication of sensor data bit rate.

3. The well bore instrument system of claim 2, wherein the controller and the first sensor are configured to store the first indicated sensor data bit rate and/or the controller and the second sensor are configured to store the second indicated sensor data bit rate.

4. The well bore instrument system of claim 2, wherein the first sensor is configured to transmit the first sensor data signals and/or the second sensor is configured to transmit the second sensor data signals, each at a continuously variable sensor data bit rate.

5. The well bore instrument system of claim 2, wherein the first sensor is configured to transmit the first sensor data signals at a first sensor data frequency which is different than a first frequency of electrical noise introduced to the system by the first sensor, and the second sensor is configured to transmit the second sensor data signals at a second sensor data frequency which is different than a second frequency of electrical noise introduced to the system by the second sensor.

6. A method for communicating measurements of environmental parameters taken within a well bore, the well bore extending down hole from a well head, the method comprising:

disposing a downhole cable section of a cable within the well bore, the downhole cable section extending lengthwise between the wellhead and a terminal end disposed down hole of the wellhead, wherein the cable also extends from the wellhead to a surface unit that includes a controller;

disposing a first sensor in communication with the cable at a first lengthwise distance along the cable from the controller, wherein the first sensor is configured to transmit first sensor data signals at a first sensor data bit rate that is based on a first amount of signal attenuation associated with the first lengthwise distance;

disposing a second sensor in communication with the cable at a second lengthwise distance along the cable from the controller, wherein the second sensor is configured to transmit second sensor data signals at a second sensor data bit rate that is based on a second amount of signal attenuation associated with the second lengthwise distance;

wherein the first lengthwise distance is greater than the second lengthwise distance, and the first amount of signal attenuation associated with the first lengthwise distance is greater than the second amount of signal attenuation associated with the second lengthwise distance, and the first sensor data bit rate is less than the second sensor data bit rate, and wherein the first sensor data signals and the second sensor data signals are each representative of at least one of said environmental parameters;

sending a plurality of first control signals to the first sensor at a control signal bit rate via the cable, and a plurality of second control signals to the second sensor at the control signal bit rate via the cable; and sending first sensor data signals at the first sensor data bit rate and second sensor data signals at the second sensor data bit rate;

wherein the first sensor data bit rate and the second sensor data bit rate are each greater than the control signal bit rate; and querying the first sensor to determine a first sensor data bit rate maxima based on the first amount of signal attenuation associated with the first lengthwise distance, and querying the second sensor to determine a second sensor data bit rate maxima based on the second amount of signal attenuation associated with the second lengthwise distance.

* * * * *